US006619341B2

(12) United States Patent
Cushing

(10) Patent No.: US 6,619,341 B2
(45) Date of Patent: Sep. 16, 2003

(54) POURING SPOUT WITH AUTOMATIC SHUT-OFF FOR PORTABLE FUEL CONTAINERS

(76) Inventor: George Cushing, 1 Amber Dr., New Fairfield, CT (US) 06812

( * ) Notice: Subject to any disclaimer, the term of this patent is extended or adjusted under 35 U.S.C. 154(b) by 0 days.

(21) Appl. No.: 10/071,047

(22) Filed: Feb. 8, 2002

(65) Prior Publication Data

US 2003/0150515 A1 Aug. 14, 2003

(51) Int. Cl.[7] ..... B67D 5/00

(52) U.S. Cl. ..... 141/198; 141/DIG. 1; 141/229; 141/308; 141/309; 222/468

(58) Field of Search ..... 141/198, 200, 141/201, 212, 216, 219–222, 308, 309, 291–295, 368; 222/51, 56, 64, 67, 468

(56) References Cited

U.S. PATENT DOCUMENTS 2,828,782 A * 4/1958 Ripley ..... 141/216
5,193,593 A * 3/1993 Denis et al. ..... 141/10
5,458,168 A * 10/1995 Lindgren ..... 141/199
6,019,114 A * 2/2000 Rodgers ..... 137/2

* cited by examiner

*Primary Examiner*—J. Casimer Jacyna
(74) *Attorney, Agent, or Firm*—Howard S. Reiter

(57) ABSTRACT

A pouring spout for hand-held portable fuel tank incorporates a float valve to automatically shut off fuel flow through the spout when the fuel level in a receiving reservoir reaches a given spatial relationship with the outlet end of the spout. An axially displaceable locking magnet within the spout locks the valve in the closed position. The locking magnet is released from its locking position by an unlatching magnet incorporated in a sealing cap. The unlatching magnet cancels the magnetic force that holds the magnetic valve in the closed position, thereby allowing it to move to its open position only when the closure cap is in position to seal the spout. The locking mechanism includes an axially displaceable magnet of given axial length, that is captured within a sealed container positioned in the pouring spout. The sealed container has an axial length greater than the length of the magnet. The sealed container can be filled with a viscous fluid to slow axial displacement of the magnet as it moves from one axial end of the container to the other. The locking magnet is displaced to one end of the container when the spout is in the upright position, which the tank assumes when it is at rest, and moves to the opposite end of the container when the spout is in the inverted position that it assumes when the tank is tilted to fill a reservoir by pouring fluid out of the tank through the spout.

9 Claims, 5 Drawing Sheets

POURING SPOUT WITH AUTOMATIC SHUT-OFF FOR PORTABLE FUEL CONTAINERS

BACKGROUND OF THE INVENTION

This invention relates generally to hand-held portable containers for liquids, such as portable fuel tanks for gasoline and the like. More specifically, this invention relates to pouring spouts for such containers, which incorporate an integral float valve mechanism that is magnetically latched and unlatched to prevent both overfilling a reservoir when liquid is poured through the spout, and to prevent unintended spillage through the valve after it has dosed. In this regard, the valve is magnetically latched in the dosed position, when filling of a reservoir is completed and it is released from that position by application of a sealing cap containing a release magnet. The cap serves as a manual seal of the spout while it remains in position, leaving the valve unlatched, open and ready to permit pouring of fluid through the spout into another container or reservoir, when the cap is removed.

Pouring spouts incorporating float valve mechanisms for use with liquid-containing portable tanks, are known in the art. Some such prior art float valve mechanisms for pouring spouts have disclosed the use of magnet elements intended to retain the valve in its dosed position, until the mechanism has been physically displaced to again permit fluid flow through the spout. Other magnetic valve mechanisms have been disclosed in connection with the inlet openings of fluid storage or receiving tanks that prevent filling of the tank unless a properly selected magnetic fill cap or nozzle is attached to "open" the inlet valve; this arrangement is intended to help prevent the possibility of filling the tank with the "wrong", e.g. unintended or improper, fluid.

However, none of the prior art devices have addressed the problem solved by this invention; that is, providing a pouring spout which is latched in its "dosed" position, after fluid has been delivered to a given level in a receiving reservoir, and then remains latched in the closed position until the spout has been manually closed by application of a sealing cap that also serves to open the magnetic latch. The prior art devices similarly fail to provide any guidance for solving the problem of controlling displacement of the latching elements between "open" and "closed" positions so as to prevent inadvertent failure to open when parts are subject to sudden or unexpected movement. For example, if the elements displace too rapidly, full release or proper latching may not take place as desired.

BRIEF SUMMARY OF THE INVENTION

It is an object of this invention to provide a pouring spout for a portable fluid tank that automatically closes and latches itself closed at a given fluid fill point and then prevents further unintended flow through the spout until the latch has been deliberately released.

A further object of this invention is the provision of a sealable, latchable pouring spout in which the seal latch is released in response to the positioning of a manual sealing cap.

Another object of this invention is the provision of a pouring spout having a magnetic latch which is responsive to the positional orientation of the spout.

Still another and further object of this invention is the provision of a pouring spout having a displaceable latching magnet, in which the rate of displacement of the magnet is slowed in a controlled manner to avoid premature operation of the latching mechanism.

These and other and further objects, features and advantages of this invention will be made apparent to those having skill in this art, by reference to the following specification considered together with the accompanying drawings, in which:

DETAILED DESCRIPTION OF THE INVENTION

Figure 1:
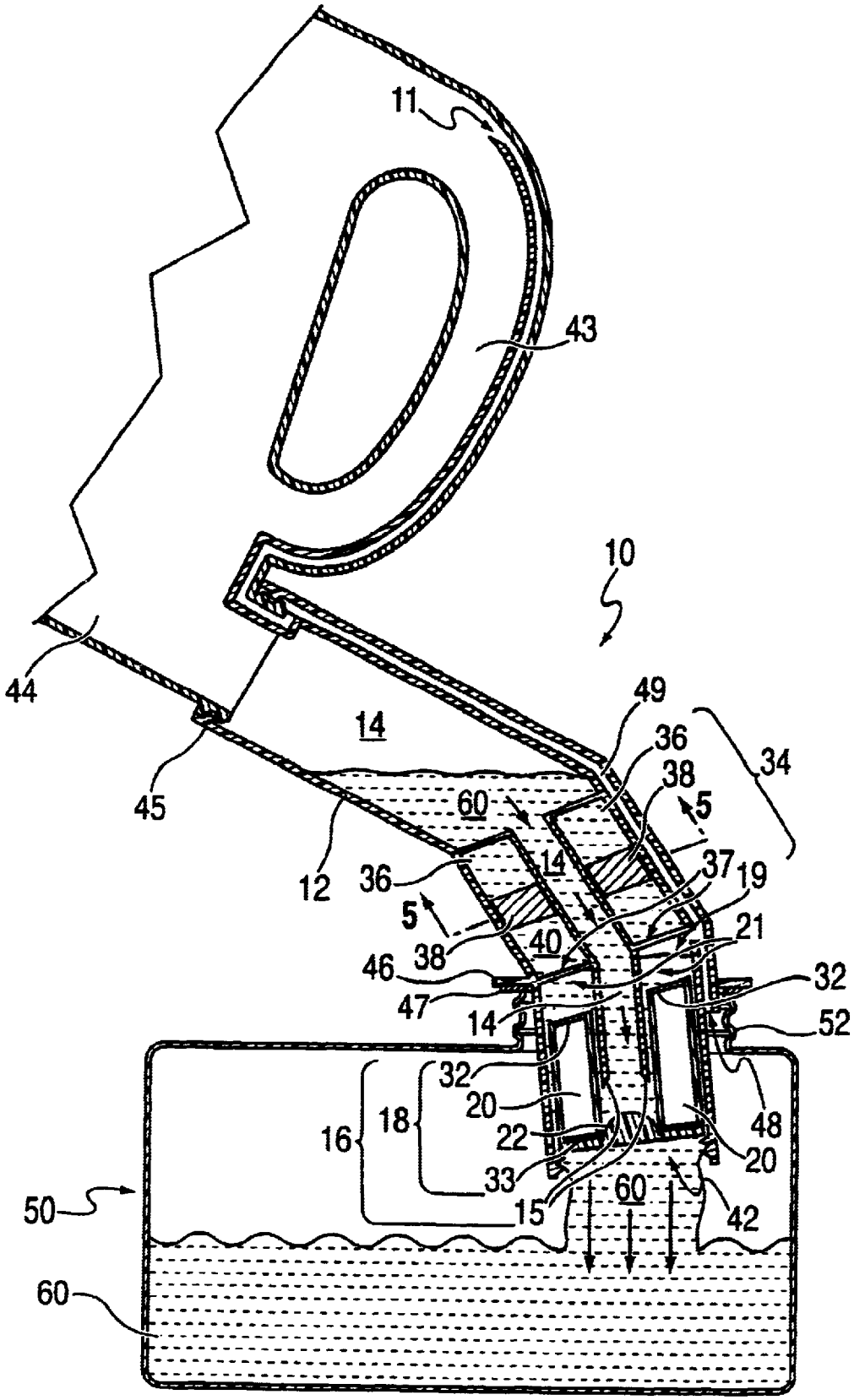
FIG. 1 is a partial side sectional view of a pouring spout and valve in accordance with this invention, showing the spout disposed in "pouring position" relationship to a receiving container with the valve in the "open and unlatched" position, allowing fluid to be poured through the spout.
Figure 2:
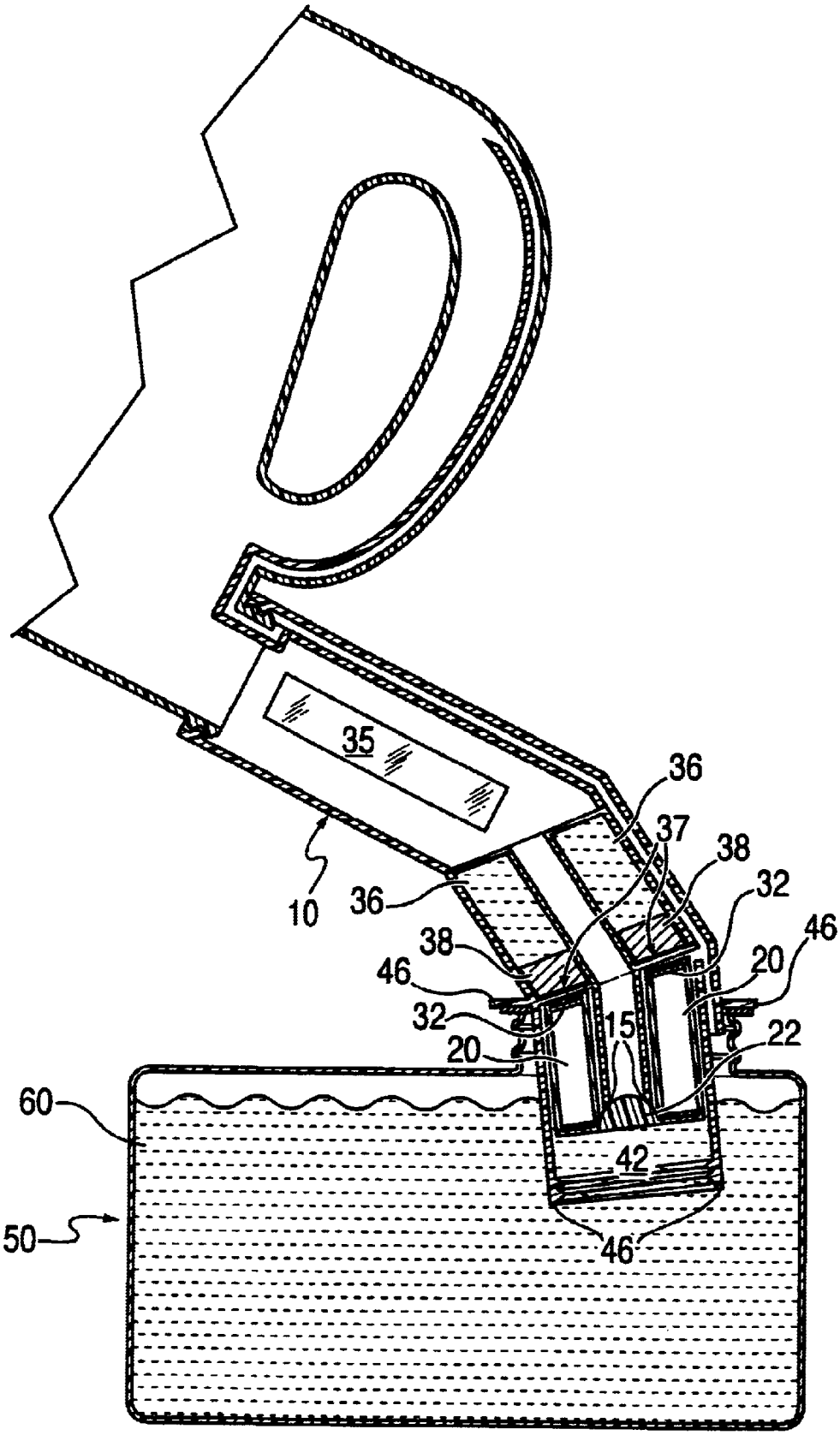
FIG. 2 is a partial side sectional view of the spout of FIG. 1, with the valve shown in the "closed and latched" position while the spout remains in the "pouring position".

Referring now more particularly to the drawings, the pouring spout 10 of this invention may be seen to comprise an elongate body member 12 having a central pouring passage for guiding the flow of fluid 60 (shown in FIG. 2 after it has been received in receiving container 50) in the manner of a pipe. Body member 12 may be formed of any suitable non-magnetic metal or plastic material in accordance with well-known practice. A valve assembly 16 having an annular valve seat 15 is mounted to body member 12 within the central pouring passage 14. Valve seat 15 is of conventional design comprising, for example, an annular beveled surface formed around the periphery of the open end of pouring passage 14. Spout 10 is attached in any conventional manner, as for example by screw threads 45, to an opening in a portable fluid tank 44 of generally conventional design. Tank 44 can be filled in any convenient manner with a fluid by unscrewing pouring spout 10 from the opening to which it is attached, or by accessing a separate filler opening [not shown]. After filling tank container 44 and securing spout in position, fluid can then be dispensed through spout 10 by tilting or inverting the tank 44 from its "at rest" orientation (shown in FIGS. 3 and 4), to deliver the fluid through the open end 42 of spout 10 into any desired receiving container 50. A first vapor recovery opening 11, formed in the handle 43 of tank container 44, gives access to a vapor recovery passageway 49 within spout 10, that in turn gives access to a second vapor recovery opening 48, that vents passage 49 to the interior of receiving container Second vapor recovery opening 48 is positioned so that it is disposed within the filler neck portion 52 of a receiving container 50 when spout 10 is inserted into filler neck portion 52 to fill the receiving container 50. To control, that is, to limit, insertion of spout 10 into neck portion 52, a depth limiting extension 46 projects from the exterior surface of spout 10 as seen in FIGS. 1 and 2, to engage the top of the filler neck 52. Preferably, projection/extension 46 is formed as a flat, planar, annular collar, the purpose of which will be made apparent as the operation of the invention is explained herein.

In accordance with this invention, shut-off valve assembly 16 comprises a float sub-assembly 18 having a float member 20 coupled to a valve stopper 22. Valve stopper 22 is movable axially relative to valve seat 15, along with float member 20, to engage and disengage the seat in conventional manner. Stopper 22 may be of any conventional design such as a tapered cylinder or a portion of a sphere, as shown. When the stopper 22 is not engaged with valve seat 15, fluid may flow through central pouring passage 14 around and past stopper 22, between the stopper and float member 20. Fluid flowing in this manner may be delivered into a receiving container 50 by directing the open end 42 of spout 10 into a conventional filler neck opening 52 of the receiving container 50. When the surface of the spherical stopper 22 engages the correspondingly beveled circular seat 15, a seal is formed in a usual manner to prevent the passage of fluid through tubular member 17 that defines a portion of central passage 14. Stopper 22 is coupled to float 20 in any suitable manner, and both stopper 22 and float 20 are configured, so as to permit fluid to flow through passage 14 past both elements when stopper 22 is disengaged from seat 15. Float member 20 is configured to be freely movable axially within pouring spout 10, so that when the open end of the spout 10 is inserted into the filler neck 52 of a receiving container 50, as shown in FIG. 2, the float will rise to the surface of liquid 60 within the receiving container, in response to buoyancy forces, until stopper 22 engages valve seat 15. Concurrently, latching magnets 38 will descend under the force of gravity until they magnetically couple with ferro-magnetic element 32 of sub-assembly 18 to "latch" stopper 22 in its closed position in engagement with seat 15. As used herein, the term "magnet" refers generally to any element formed of material having magnetic properties, that is, the capacity to attract iron, steel and other magnetizable material, whereas, "ferromagnetic" refers generally to magnetizable materials that are not necessarily in a magnetic state.

Figure 4:
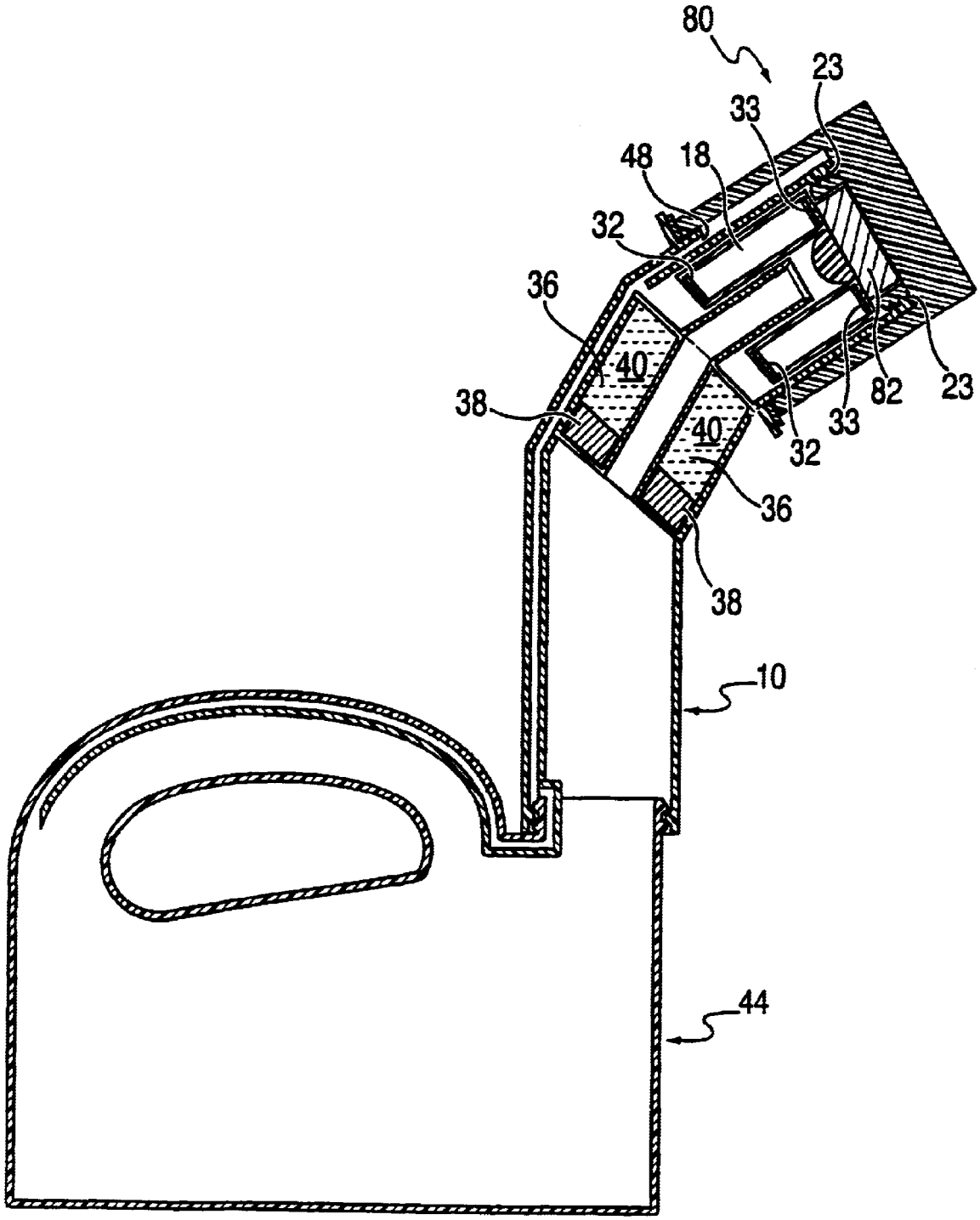
FIG. 4 is a partial side sectional view of the spout shown in the "at rest" position of FIG. 3, but with the valve now shown in the "open and unlatched" position and with a manual sealing cap, in accordance with this invention, positioned on the spout.

Further in accordance with this invention, float subassembly 18 is provided with one or more ferro-magnetic elements 32, 33, which have a disk or toroidal shape surrounding passageway 14, and are coupled to float member 20 for interaction with magnetic sub-assembly 34, and with release cap 80. The release cap 80 is shown in FIG. 4 and is further explained, subsequently, herein. Similarly, the function of ferro-magnetic elements 32, 33 will be explained in more detail below in relation to displaceable magnet sub assembly 34.

Figure 5:
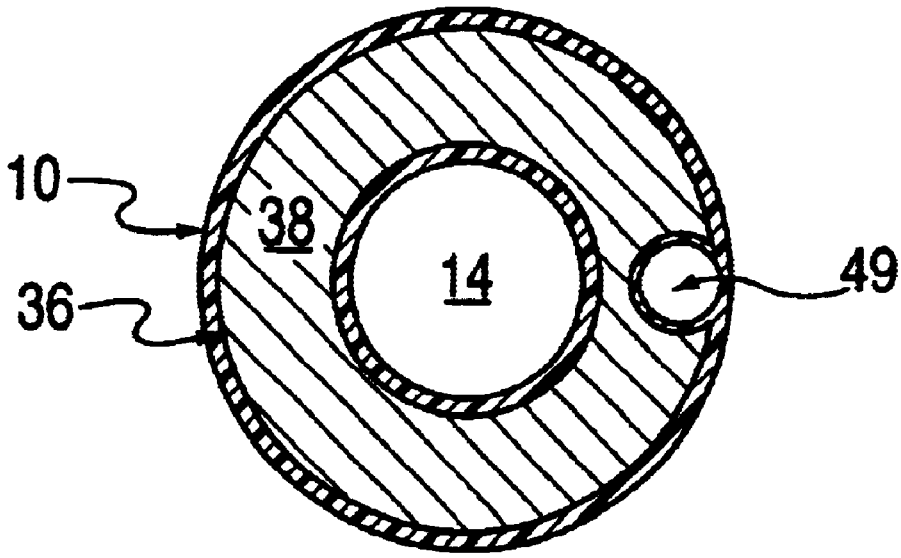
FIG. 5 is a cross-sectional view of the spout taken in plane 5—5 of FIG. 1.
Figure 6:
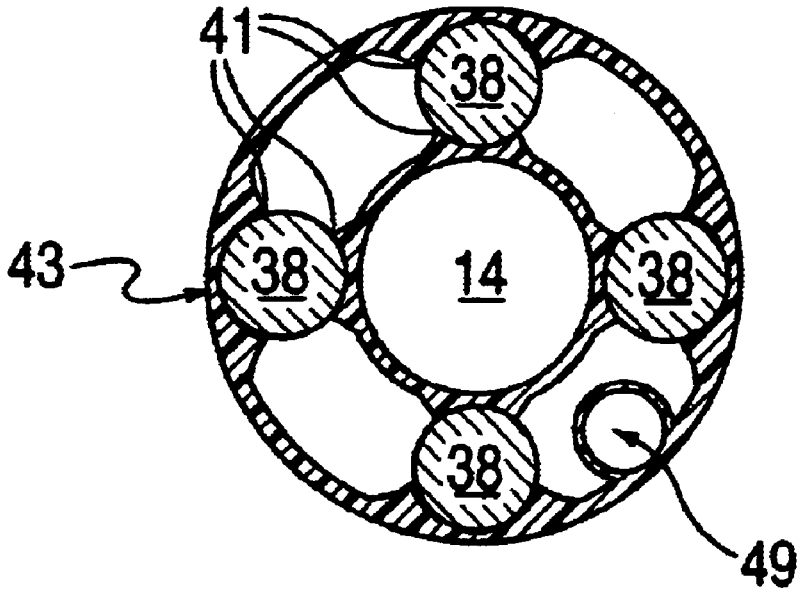
FIG. 6 is a cross-sectional view similar to FIG. 5, showing an alternative embodiment of a spout in accordance with this invention.

Magnet subassembly 34 can be seen to comprise a magnet container 36 containing one or more displaceable latching magnet elements 38. Magnet element 38 preferably has a generally toroidal shape, as illustrated in FIG. 5. Alternatively, magnets 38 may be a plurality of elongate, axially extending individual magnet bars, and longitudinal ribs 41 and/or longitudinal grooves 43 formed on one or more of the interior walls of container 36 maintain the orientation of the magnets within the container, thereby to assure that like poles of each magnet are always oriented in a consistent direction. Accordingly, magnet or magnets 38 will be oriented correctly to magnetically attract ferromagnetic disk 32 when the two are positioned in proximity to each other, while bar magnets 38 will also remain free to be displaced axially from one end of the container to the other. FIG. 6 illustrates this alternative cross-sectional structure of container 36, that facilitates operation of this embodiment of the invention, using bar magnets.

The toroidal shape of container 36 defines a central axial opening 14 forming a flow channel for fluid 60 to flow through and past container 36 within spout 10. As fluid flows through the spout, vapors in receiving container 50 are prevented from escaping into the atmosphere by annular disk-shaped depth limiter 46 and flexible gasket 47 that forms a seal between limiter 46 and filler neck 52. Any vapors thus are forced through vapor recovery opening 48, vapor recovery tube 49, and vapor recovery opening 11 into tank 44. Vapor recovery tube 49 also relieves pressure that builds up in space 21 between container 36 and subassembly 18, by allowing vapor to pass through vapor recovery opening 19 into vapor recovery tube 49 as float 20 rises, thus allowing valve stopper 22 to engage with valve seat 15.

As shown in FIG. 2, stop elements 46 determines the fully-inserted position of spout 10 relative to receiving container 50, so that when the level of fluid 60 within the receiving container reaches a given level relative to the spout, float member 20 will urge ferromagnetic element 32 into abutting engagement with the end surface 37 of magnet container 36. Further, as shown dearly in FIG. 2, the inverted orientation of spout 10 in its "filling" or "pouring" position, results in magnets 38 having settled to the end of magnet container 36 proximate the end surface 37. In this position, magnet 38 magnetically engages ferromagnetic disk element 32 to retain valve stopper 22 in closed sealing engagement with valve seat 15. Accordingly, valve assembly 16 is "latched" in the dosed position, and further flow of fluid through spout 10 is prevented until the valve has been unlatched and allowed to open.

Figure 3:
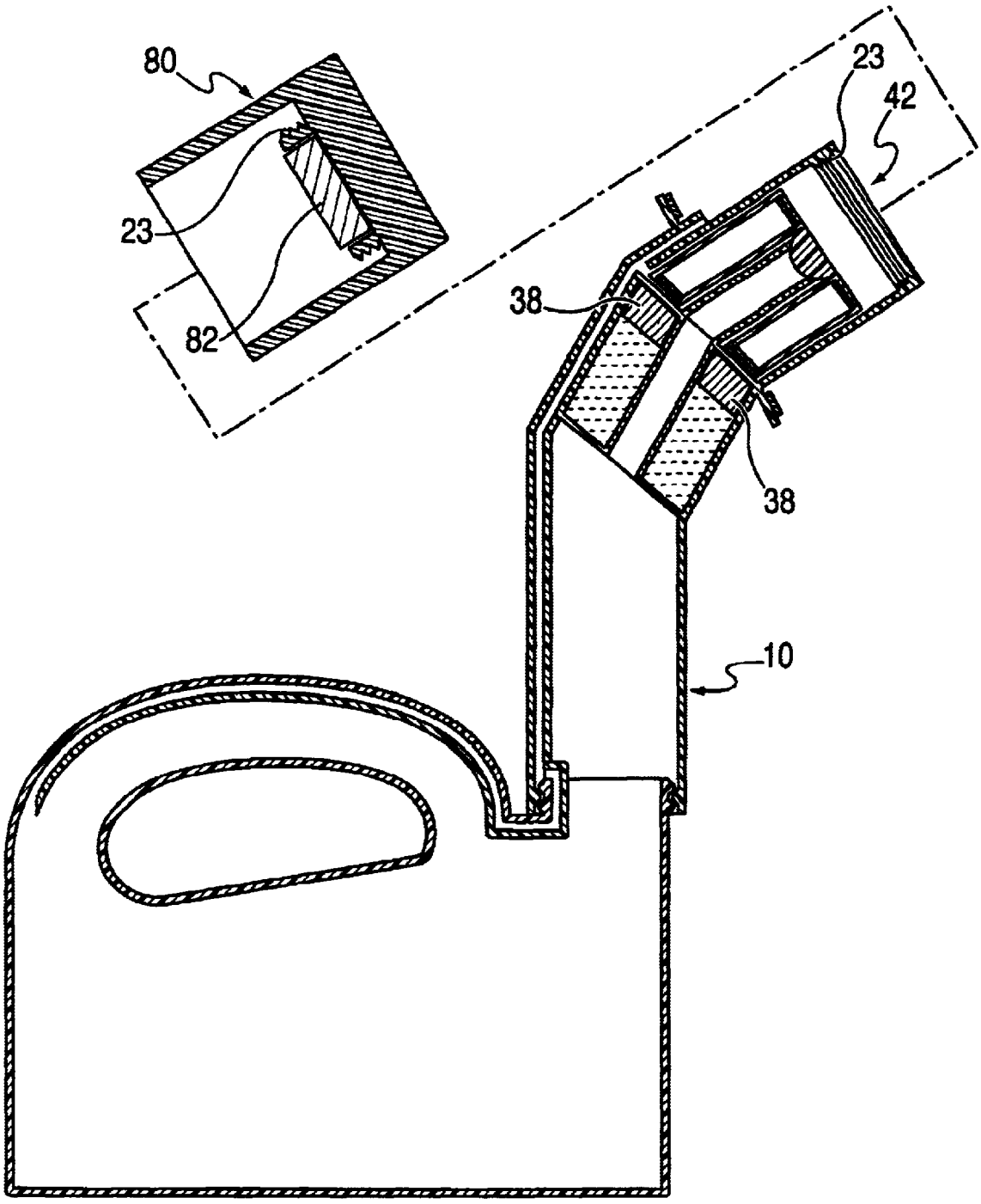
FIG. 3 is a partial side sectional view of the spout of FIG. 1, with the valve shown in the "closed and latched" position and with the spout shown oriented in an "upright" or "at rest" position.

For convenience in understanding this invention as well as the drawings, magnet 38 is shown in FIG. 1 at a midway point, as it is displaced by gravity, between the unlatched, "at rest" position of FIG. 4, and the latched position shown in FIGS. 2 and 3. For still further convenience, FIG. 3 shows magnet 38 and subassembly 18 in the "latched" position, with spout 10 in its "at rest" position, while FIG. 2 shows magnet 38 in the "latched" position that it assumes when the spout is in the "pouring" position just as fluid 60 reaches the desired level in receiving container 50. And, finally, FIG. 4 shows magnet 38 in its "unlatched" position near the inner end of spout 10 proximate the portable fluid tank 44 to which the spout is coupled.

Sealed container 36 may be filled with a fluid such as a viscous liquid 40 substantially filling the interior of the container, and surrounding magnet elements 38. The fluid within container 36 provides a damping action to slow the displacement of magnet element 38 from one end of the container to the other, as spout 10 is tilted back and forth between the "at rest" position shown in FIG. 4, and the "pouring" position shown in FIG. 1. Preferably, however, container 36 is filled with air or any easily displaced suitable fluid such as an inert gas, because it has been found that if fluid 40 is too viscous, it may unduly slow or completely prevent, the necessary displacement of magnet elements 38 within container 36 if the fluid is unable to flow past the magnets; in this regard, the size of the magnets 38 relative to the interior of container 36 can be dimensioned to control the clearance space between the magnets and the inner walls of the container through which the fluid must be displaced as the magnets move.

In the condition represented in FIG. 4, spout 10 is "at rest" and unlatched, and a sealing cap 80 is coupled to the open end 42 of spout 10, to provide a manual closure/seal of both the open end 42 and vapor recovery passage 48. It will be understood by those skilled in this art, that the closure cap may be coupled to spout 10 merely by force-fitting the spout and the cap together, or by any suitable and well-known fastening means such as the use of mating cap-screw threads 23 formed on both the cap and the spout as shown in FIG. 3 of the drawings. Sealing cap 80 has one or more unlatching magnets 82 mounted thereon oriented to attract the ferro-magnetic element 33 away from displaceable magnets 38 in container 36 so as to release the magnetic attraction between magnets 38 and disk element 32. A window portion 35 of spout 10 is made of a transparent material so that fluid flow can be observed, allowing an operator to remove the pouring spout 10 from receiving container 50 when fluid flow in the spout has stopped. Alternatively, spout 10 can be formed entirely of transparent material to perform the same function as window 35.

Accordingly, as explained previously, when float member 20 moves to the position shown in FIG. 2, the flow of fluid through the spout is cut off and valve assembly 16 remains closed until cap 80 is applied to manually seal the spout against further fluid flow, the movement of float sub-assembly member 20 concurrently releases the magnetic force of magnets 38 that holds disk 32 in "latched" position against end surface 37 of container 36, and similarly holds valve stopper 22 against valve seat 15. When magnets 38 move to the position shown in FIG. 4, under the force of gravity, magnets 82 in cap 80 remain magnetically coupled to ferro-magnetic disk 33. Magnets 82 may, if desired, be dimensioned to draw disk 33, of float sub-assembly 18, outwardly from spout 10, into an open, unlatched position, when cap 80 is removed from the spout, as shown in FIG. 4, preparatory to the start of a pouring operation. Proper selection of the magnetic force coupling magnets 82 to element 33 will assure separation of element 32 from magnets 38 as cap 80 is removed from its "capping position. This, in turn, will separate valve element 22 from valve seat 15, allowing fluid tb flow through passage 14 when spout 10 is moved to its pouring position. Retention means, such as inwardly projecting threads 23 at the open end of spout 10 serve to limit the outward axial displacement of float sub-assembly 20 relative to spout 10. When tank 44 is tilted into the pouring position shown in FIG. 1 following removal of cap 80, float assembly 18 will necessarily fall into its extended, open position, under the effect of gravity, and magnets 38 will also descend toward the open end 37 of container 36; however, as a result of the slowing effect of damping fluid 40 within container 36, magnets 38 will always arrive at end surface 37 at a time when disk 32 has already moved away from that surface, thereby preventing unintended and undesirable locking of float assembly 18 in the "dosed" position.

It should now be understood that the invention herein disclosed comprises a pouring spout for a portable fluid tank incorporating a float valve having novel magnetic latching and unlatching features enhanced by a viscous fluid damping feature that effectively precludes sudden movements of the latching magnet elements so as to prevent unintended latching of the valve assembly.

Although preferred embodiments of the invention have been illustrated and described, it will be obvious to those having skill in this art that the invention may be practiced in various other forms and embodiments without departing substantially from the spirit and scope of the subject matter herein set forth and particularly pointed out in the accompanying claims.

What is claimed is:

1. A pouring spout for delivering fluid from a portable fluid tank to a receiving reservoir, said pouring spout comprising:

a body member having a fluid passage extending axially therethrough from an inlet end to an outlet end, said body member being tiltable between an at rest position characterized by said inlet end being relatively lower that said outlet end, and a pouring position characterized by said outlet end being relatively lower than said inlet end;

a magnet container having a given axial length coupled to said body member substantially parallel to said fluid passage;

a movable latching magnet member having an axial dimension less than said given axial length of said magnet container, said movable latching magnet member being positioned within said magnet container and being axially displaceable between a first position remote from said inlet end of said fluid passage and a second position remote from said outlet end of said fluid passage;

an annular valve seat formed within said fluid passage, having a central opening forming part of said fluid passage;

a valve member movably coupled to said body member for axial displacement relative thereto, and having a float portion dimensioned to float at the surface of a fluid in a receiving reservoir in which said spout is immersed, said float portion being positioned proximate said outlet end of said body member;

a float valve stopper member coupled to said float portion;

said float valve stopper member being movable between a closed position, in which it engages said annular valve seat to prevent passage of fluid therethrough, and an open position, in which it is disengaged from said annular valve seat to permit passage of fluid therethrough;

a ferro-magnetic latching member coupled to said valve stopper member and positioned for magnetic coupling with said movable latching magnet member to retain said valve stopper member in said dosed position when said movable latching magnet member is positioned remote from said inlet end of said fluid passage.

2. A pouring spout for delivering fluid from a portable fluid tank to a receiving reservoir in accordance with claim 1, wherein:

said magnet container contains a viscous fluid for slowing axial displacement of said movable latching magnet member within said magnet container.

3. A pouring spout for delivering fluid from a portable fluid tank to a receiving reservoir in accordance with claim 1, wherein:

said container is filled with a gas and said movable latching magnet is dimensioned to restrict the flow of gas between said latching magnet and said container for slowing axial displacement of said latching magnet within said magnet container.

4. A pouring spout for delivering fluid from a portable fluid tank to a receiving reservoir in accordance with claim 3, wherein:

said gas within said magnet container is air.

5. A pouring spout for delivering fluid from a portable fluid tank to a receiving reservoir in accordance with claim 1, further comprising:

a vapor recovery passageway associated with said body member having a first vent opening proximate said outlet end of said body member and a second vent opening proximate said inlet end of said body member.

6. A pouring spout for delivering fluid from a portable fluid tank to a receiving reservoir in accordance with claim 5, further comprising:

a third vent opening in said vapor recovery passageway, opening into the interior of said body member intermediate said magnet container and said float portion of said valve member.

7. A pouring spout for delivering fluid from a portable fluid tank to a receiving reservoir in accordance with claim 1, further comprising:

an unlatching cap separably attached to said body member at said outlet end of said fluid passage;

said unlatching cap having an unlatching magnet member therein positioned to release the magnetic coupling between said ferro-magnetic latching member and said latching magnet by magnetically urging said ferro-magnetic latching member toward a position remote from said movable latching magnet when said latching cap is attached to or removed from said body member;

said unlatching cap acting as an additional closure for said fluid passage to prevent unintended fluid flow through said outlet end of said fluid passage when said cap is attached to said body member.

8. A pouring spout for delivering fluid from a portable fluid tank to a receiving reservoir in accordance with claim 1, wherein:

at least a portion of said body member is formed of a transparent material permitting visual observation to determine if fluid is flowing within said body member.

9. A portable fluid tank having a pouring spout with a magnetically latchable valve incorporated therein, said fluid tank comprising:

a fluid tank, a pouring spout coupled to said fluid tank;

said pouring spout having a fluid passage extending axially therethrough from an inlet end open to said tank, to an outlet end dimensioned to be inserted into a receiving reservoir, said fluid tank being tiltable between an at rest position in which said inlet end of said pouring spout is relatively lower that said outlet end, and a pouring position in which said outlet end of said pouring spout is relatively lower than said inlet end;

a magnet container having a given axial length coupled to said pouring spout;

a movable latching magnet member having an axial dimension less than said given axial length of said magnet container, said movable latching magnet member being positioned within said magnet container and being axially displaceable between a first position remote from said inlet end of said fluid passage and a second position remote from said outlet end of said fluid passage;

said movable latching magnet member being aligned for axial displacement in a direction substantially parallel to said fluid passage in said pouring spout; said magnet container containing a fluid for slowing axial displacement of said magnet member within said magnet container;

an annular valve seat within said fluid passage, having a central opening forming part of said fluid passage;

a float valve member coupled to said pouring spout proximate said outlet end thereof and having a movable float portion positioned to be axially displaced by fluid buoyancy forces when said outlet end is immersed in fluid in a receiving reservoir;

a valve stopper portion coupled to said float member, and movable between a closed position in which said valve stopper portion engages said annular valve seat to prevent passage of fluid therethrough and an open position in which said valve stopper portion is disengaged from said annular valve seat to permit passage of fluid therethrough;

a ferro-magnetic latching member coupled to said valve stopper member and positioned for magnetic attraction to said movable latching magnet member to retain said valve plug member in said dosed position when said movable latching magnet member is positioned remote from said inlet end of said fluid passage.

* * * * *